US008608514B2

(12) United States Patent
Kolkman

(10) Patent No.: US 8,608,514 B2
(45) Date of Patent: Dec. 17, 2013

(54) CONNECTOR BLOCK WITH PARALLEL ELECTRICAL CONNECTION

(75) Inventor: Albertus Jan Hendrik Kolkman, Dalen (NL)

(73) Assignee: Emerson Electric Co., St. Louis, MO (US)

( * ) Notice: Subject to any disclaimer, the term of this patent is extended or adjusted under 35 U.S.C. 154(b) by 83 days.

(21) Appl. No.: 13/358,605

(22) Filed: Jan. 26, 2012

(65) Prior Publication Data

US 2013/0196528 A1 Aug. 1, 2013

(51) Int. Cl.
*H01R 24/00* (2011.01)

(52) U.S. Cl.
USPC ..... 439/685; 439/682

(58) Field of Classification Search
USPC ..... 439/682, 685, 689, 367
See application file for complete search history.

(56) References Cited

U.S. PATENT DOCUMENTS

| | | | | |
|---|---|---|---|---|
| 3,160,460 | A | 12/1964 | Wyzenbeek | |
| 4,109,992 | A * | 8/1978 | Hughes et al. | 439/620.21 |
| 4,523,798 | A | 6/1985 | Barrows et al. | |
| 4,748,531 | A | 5/1988 | Ortiz | |
| 4,966,559 | A * | 10/1990 | Wisner | 439/566 |
| 5,129,843 | A | 7/1992 | Bowsky et al. | |
| D340,911 | S | 11/1993 | Bowsky et al. | |
| 5,336,105 | A * | 8/1994 | Wisner | 439/367 |
| 5,580,282 | A | 12/1996 | Paterek | |
| 5,894,179 | A | 4/1999 | Filla et al. | |
| 6,290,528 | B1 | 9/2001 | Moore, Jr. et al. | |
| 6,300,698 | B1 | 10/2001 | Fargo et al. | |
| 6,305,989 | B1 | 10/2001 | Quadir | |
| 6,699,078 | B2 | 3/2004 | Quadir | |
| 6,910,904 | B2 * | 6/2005 | Herrick et al. | 439/271 |
| 6,916,210 | B2 | 7/2005 | Moore, Jr. et al. | |
| 7,175,448 | B2 | 2/2007 | Berning | |
| 7,527,530 | B2 | 5/2009 | Olejniczak et al. | |
| 2008/0279703 | A1 | 11/2008 | Wang et al. | |

FOREIGN PATENT DOCUMENTS

| | | |
|---|---|---|
| DE | 102007045400 | 4/2009 |
| WO | WO2007095249 | 8/2007 |

* cited by examiner

*Primary Examiner* — Hien Vu
(74) *Attorney, Agent, or Firm* — Harness, Dickey & Pierce, P.L.C.

(57) ABSTRACT

An external connector block that can be positioned over multiple standard-sized power supply terminals that are secured to the housing of, e.g., a compressor is disclosed. The connector block includes an electrically conductive bridge connecting respective pins of the terminals in parallel. By connecting the terminals in parallel, the connector block increases the maximum allowable operating current of a terminal connection, while still utilizing standard-sized power terminal feed-throughs. As such, the connector block of the present disclosure may enable higher power rated applications without requiring a new power supply terminal design.

14 Claims, 8 Drawing Sheets

CONNECTOR BLOCK WITH PARALLEL ELECTRICAL CONNECTION

FIELD

The present disclosure relates to electrical connections for a hermetic compressor. More specifically, the present disclosure relates to a connector block having a parallel electrical connection for connecting a plurality of terminals.

BACKGROUND

This section provides background information related to the present disclosure which is not necessarily prior art.

Hermetically sealed motor-compressor units are prevalent in refrigeration applications where the motor-compressor units are employed to compress refrigerant vapor. The compressor is generally driven by an electric motor which rotates a crankshaft of the compressor at relatively high speeds. These hermetically sealed motor-compressor units are frequently located in environments where it becomes necessary to protect the connections to the electrical system and ensure that the integrity of the electrical connections is maintained. Typical electrical connections for a hermetically sealed compressor include power lines for providing electricity for operating the electric motor and control circuitry which monitors the operation of the compressor.

Typically, one or more hermetic terminals are provided in the motor-compressor unit to allow electric power and/or electrical monitoring systems to extend through a housing of the motor-compressor unit. Power supply terminals typically include a body member welded or otherwise secured to the housing. The body member has a plurality of current conducting pins which are hermetically secured to and extend through the housing such that one end of each current conducting pin is located within the housing and the opposite end is located outside the housing. Electrical insulating and sealing material such as glass and/or epoxy forms a hermetic seal between each current conducting pin and the body member. The internal end of each current conducting pin is connected to electrical leads of the electric motor. The external end of each conductor is connected to a power supply by way of a connector block that attaches to the current conducting pins of the terminal. Typically, the electric motor is powered by a 3-wire single-phase electricity distribution system and the terminals include three current conducting pins.

In order to provide protection and sealing for the terminals, a terminal box is attached to the housing around the various terminals. The terminal box includes the appropriate cutouts to provide access to the various terminals, and seals are provided around these cutouts in order to protect the terminals from the outside environment. Typically, an external connector block is positioned over the power supply terminal with this external connector block being held in place by a terminal box cover which closes the terminal box. The external power is typically provided by a plurality of conductors which are attached to the external connector block. Each of the plurality of conductors electrically engages a respective current conducting pin when the external connector block is assembled to the power supply terminal. Once this connection is made, the terminal cover is attached to the terminal box to retain the external connector block and isolate the electrical connections within the terminal box.

On the inside of the housing, an internal connector block is positioned over the power supply terminal. The internal connector block routes electrical power from the power supply terminal to the electric motor which drives the compressor.

The internal connector block includes a plurality of connectors or end fittings which frictionally engage the current conducting pins of the power supply terminal. It is preferred that the size of the internal connector block be kept as small as possible so that it does not interfere with the other components of the motor-compressor unit located inside the housing.

More frequently, new compressor applications require ever increasing electrical amperages (i.e., a higher electrical current) to be supplied to the electric motor. In some cases, requested power ratings for new applications exceed that of the largest available standard power supply terminal. One approach to dealing with higher amperage is to increase the diameter of the current conducting pins, which in turn increases the size of the power supply terminal, the external connector block, and the internal connector block.

In addition to creating unwanted size increases, such a solution requires investments in tooling and other disadvantages.

SUMMARY

The present disclosure provides the art with an external connector block that can be positioned over two standard-sized power supply terminals that are secured to a compressor shell. The connector block includes an electrically conductive bridge connecting respective pins of the two terminals in parallel. By connecting the two terminals in parallel, the connector block doubles the maximum allowable operating current of terminal connection, while still utilizing standard-sized power terminal feed-throughs. As such, the connector block of the present disclosure may be used in higher power rated applications without requiring a new power supply terminal design.

The parallel connection of the present disclosure allows higher compressor operating currents than what can be achieved (within the dimensions of existing power supply terminals) by employing serial connection designs. The present disclosure advantageously avoids the need to invest in a new, larger power supply terminal design and tooling, including a terminal cap tool, terminal welding machinery, and associated terminal sealing fixtures. The present disclosure also allows terminal customers to continue to use standard, existing connector blocks on the inside of the compressor housing. For example, two internal connector blocks can connect to the two terminals in parallel to the motor windings. The present disclosure also does not affect the compressors' hydrostatic burst pressure rating, which would otherwise be expected in the case where larger terminal caps (welded into larger mounting holes in the compressor shell) are used.

The connector block provides an easy external 3-wire connection for a 3-wire single-phase distribution system, which is the same as the 3-wire connection of Fusite's present strap models. The 3-wire connection reduces the risk of making an incorrect connection with the electric motor.

In various aspects, the connector block can be scaled up to connect three or more terminals in parallel, as may be desired in various applications. It will be appreciated that the connector block can be used with electrical devices other than hermetically sealed motor-compressor units.

According to the present disclosure, an exemplary connector block includes a nonconductive body having a longitudinal axis and a support having a first side and a second side. A first boss is disposed on the first side of the support and adapted to engage a first terminal, the first boss and the support defining a first set of N holes extending through the first boss and the support to the second side and adapted to receive a first set of N current conducting pins of the first terminal, N being an integer greater than two. A second boss is disposed on the first side of the support and adapted to engage a second terminal, the second boss is longitudinally spaced apart from the first boss, the second boss and the support defining a second set of N holes extending through the second boss and the support to the second side and adapted to receive a second set of N current conducting pins of the second terminal. Further, walls extending from the second side define longitudinally extending channels separated from each other by the walls and a plurality of conductive connectors are coupled to the second side of the nonconductive body, each extending longitudinally within a respective one of the channels and adapted to connect a first pin of the first set of current conducting pins to a respective second pin of the second set of current conducting pins via a first hole of the first set of holes and a second hole of the second set of holes.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
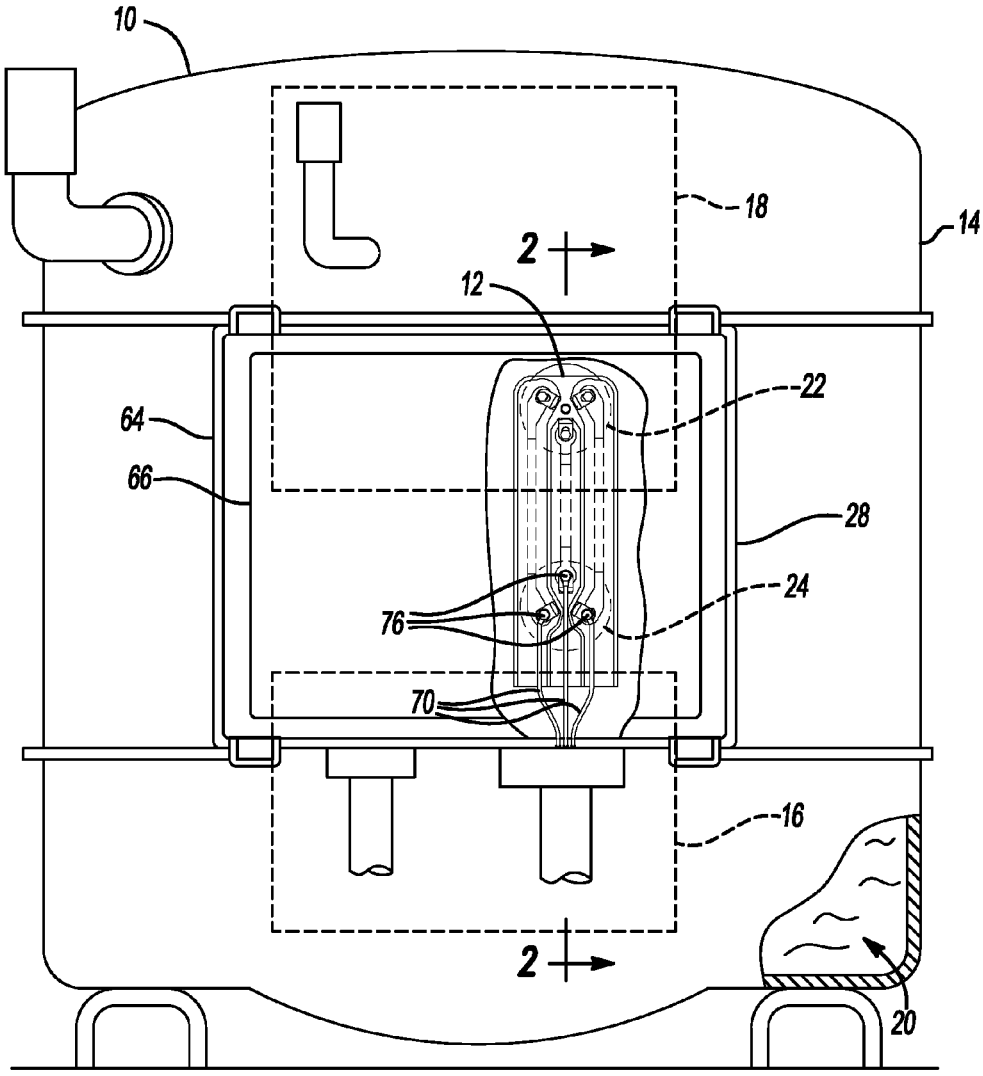
FIG. 1 is an elevational view illustrating a connector block according to the present disclosure connected to two power supply terminals of a refrigeration compressor.
Figure 2:
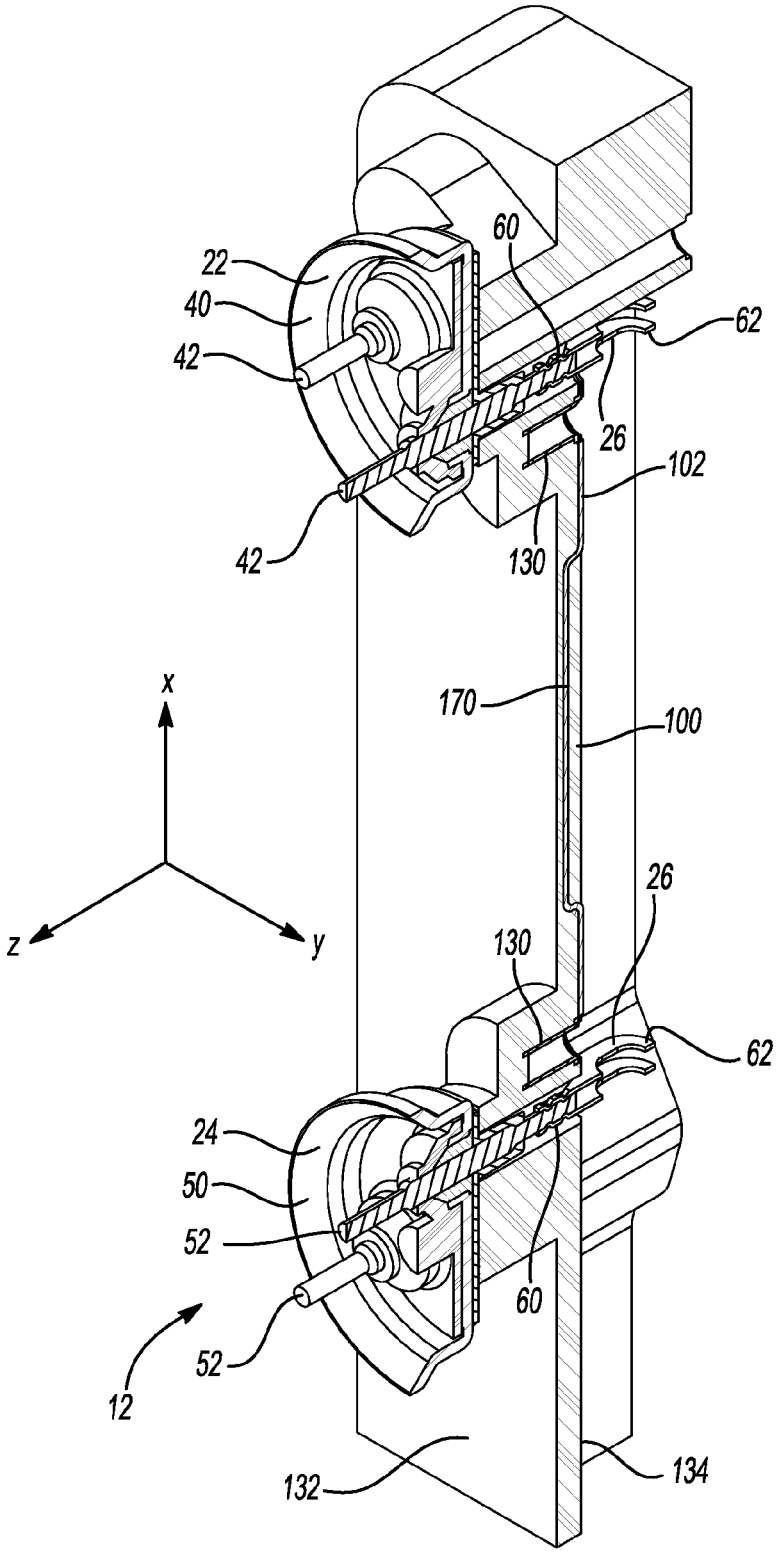
FIG. 2 is a partial cross-sectional view illustrating terminals of the refrigeration compressor and the connector block of FIG. 1 taken along line 2-2.
Figure 3:
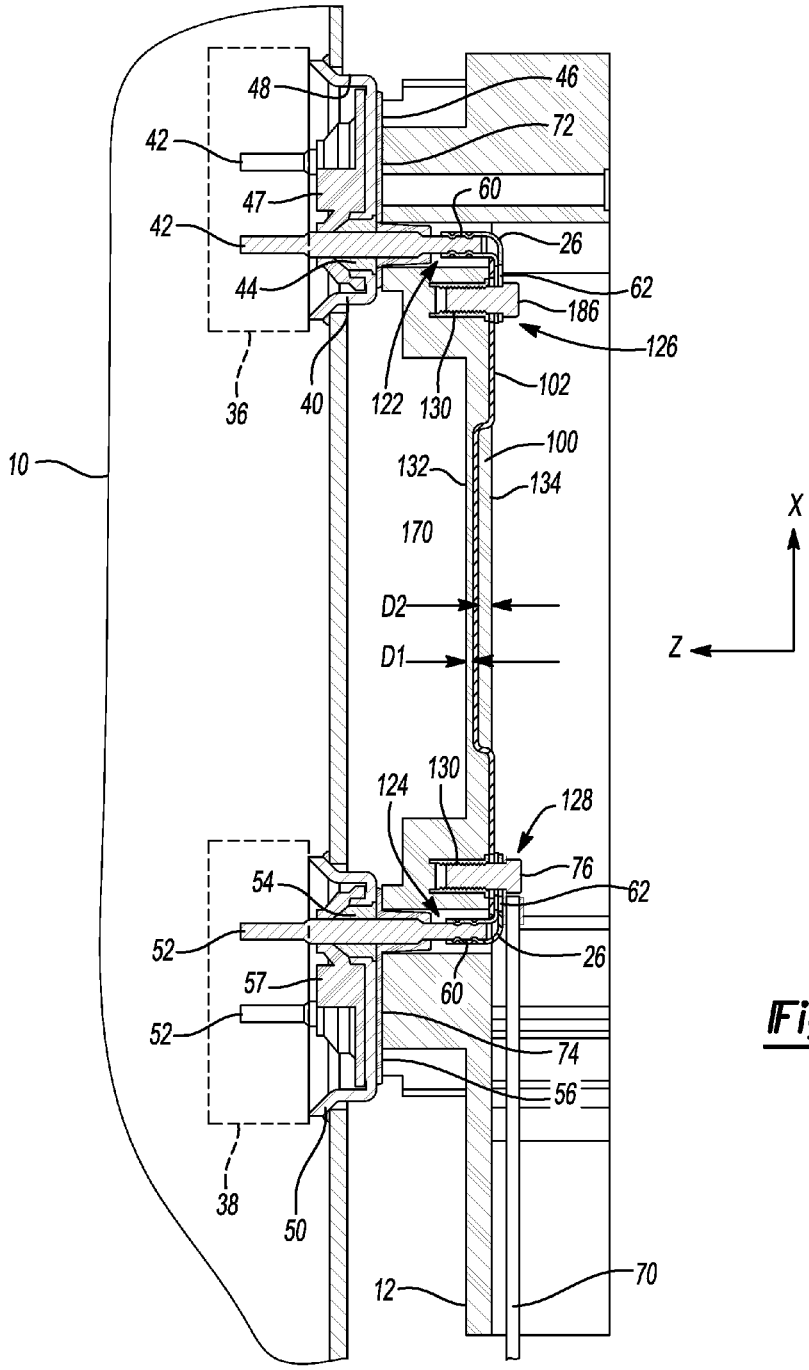
FIG. 3 is partial cross-sectional view illustrating the refrigeration compressor and the connector block of FIG. 1 taken along line 2-2.
Figure 4:
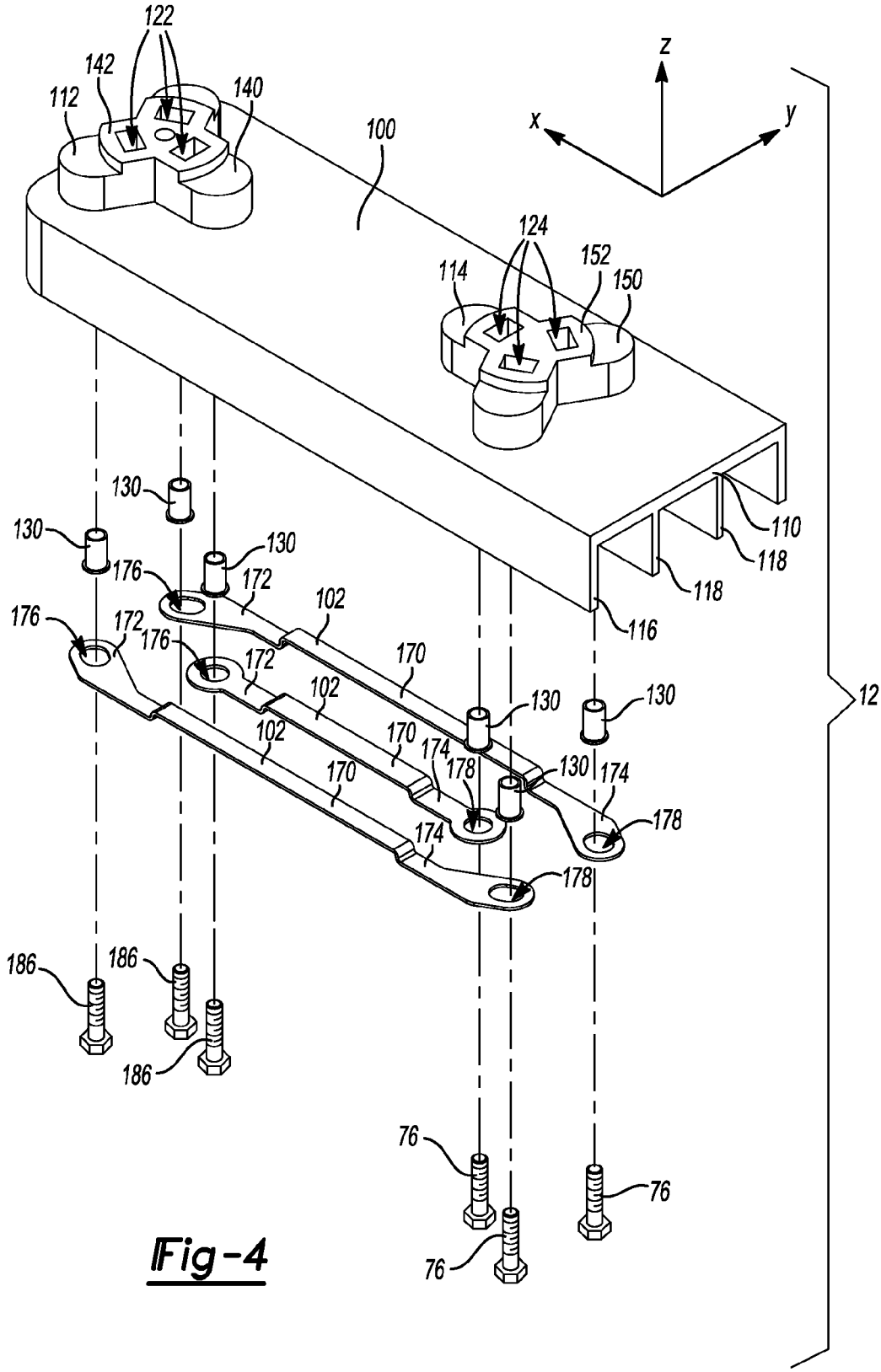
FIG. 4 is an exploded perspective view of the connector block of FIG. 1.

Referring now to the drawings, a hermetically sealed compressor assembly 10 connected to an external connector block 12 according to the present disclosure is illustrated in FIGS. 1-3. Connector block 12 connects compressor assembly 10 to an external power source (not shown). While a compressor assembly used for refrigeration is illustrated for purposes of the present example, it will be appreciated from the following description that connector block 12 can be used with other electrical machines. Compressor assembly 10 can be a scroll compressor, a piston compressor, a screw compressor, or any other type of compressor known in the refrigeration art. Compressor assembly 10 includes a shell 14, an electric motor 16, and a compressor 18. Shell 14 defines a hermetically sealed chamber 20 within which electric motor 16 and compressor 18 are disposed. Electric motor 16 drives compressor 18.

Compressor assembly 10 further includes terminals 22, 24, conductive coupling members or straps 26, and a terminal box 28. Terminals 22, 24 extend through shell 14 and provide an electrical connection through which power is supplied to electric motor 16. Terminals 22, 24 are connected in parallel to the external power source via connector block 12. Terminals 22 and 24 are connected in parallel to windings of electric motor 16 via internal connector blocks 36 and 38 (FIG. 3), respectively. Terminals 22, 24 can be any suitable terminals known in the art. As illustrated by the present example, terminals 22, 24 can be existing, standard "3K3" terminals sold by the FUSITE Division of Emerson Electric Co., Cincinnati, Ohio. Internal connector blocks 36, 38 can be any suitable internal connector blocks known in the art. For example, internal connector blocks 36, 38 can be existing, standard connector blocks known in the art.

With particular reference to FIGS. 2-3, terminal 22 includes a body member 40, a plurality of current conducting pins 42, a plurality of insulators 44, and elastomeric over surface protection coverings 46, 47. Body member 40 is generally circular in shape and is secured within an aperture 48 formed within shell 14 by resistance welds. According to the present example, three current conducting pins 42 are illustrated (see FIG. 1), however the number of current conducting pins provided can vary. Current conducting pins 42 extend through body member 40. Insulators 44 are disposed between respective current conducting pins 42 and body member 40. Over surface protection covering 46 is positioned over a portion of each of the current conducting pins 42 and is disposed on body member 40 on the exterior side of terminal 22. Over surface protection covering 47 is positioned over a portion of each of the current conducting pins 42 and is disposed on body member 40 on the interior side of terminal 22. The current conducting pins 42 are hermetically sealed to the body member 40.

Terminal 24 is identical to terminal 22 and includes a body member 50, a plurality of current conducting pins 52, a plurality of insulators 54, and over surface protection covering 56, 57. Body member 50, current conducting pins 52, insulators 54, and over surface protection covering 56, 57 can be identical to body member 40, current conducting pins 42, insulators 44, and over surface protection covering 46, 47. For brevity, a detailed description of terminal 24 will be omitted with the understanding that the above description of terminal 22 applies equally to terminal 24. According to the present example, three current conducting pins 52 are provided and are connected in parallel to respective current conducting pins 42 via connector block 12 as described in further detail below. While an equal number of current conducting pins 42, 52 are illustrated, the terminals 22, 24 may have an unequal number of current conducting pins as may be desired, for example, to accommodate separate communication connections. In this case, a common set of current conducting pins for supplying power can be connected in parallel by connector block 12 according to the principles of the present disclosure.

Coupling straps 26 are each resistance welded or otherwise fixedly attached to an associated one of the current conducting pins 42, 52. Coupling straps 26 are configured to pass through connector block 12 when in a first straight configuration as shown in FIG. 2 and to be bent into a second L-shaped configuration used to secure connector block 12 to compressor assembly 10 as shown in FIG. 3. Each coupling strap 26 includes a pin engaging section 60 and a strap engaging section 62 formed by two separate parts. Each of the parts is made of a conductive material, preferably a bimetal of copper and cold rolled steel. Copper is used on one side to facilitate electrical connections with respective conductive pins 42, 52. Cold rolled steel is used on an opposite side to facilitate resistance welding coupling straps 26 to conductive pins 42, 52. When secured to connector block 12, coupling straps 26 create electrical connections between respective current conducting pins 42, 52 as discussed in further detail below.

Terminal box 28 is secured to the exterior of shell 14 and houses connector block 12, terminals 22, 24, as well as the electrical connections between connector block 12, terminals 22, 24, and the external power source. Terminal box 28 includes a body 64 having a generally rectangular box shape and a cover 66 pivotally secured to body 64. Cover 66 is movable between a closed position and an open position. In the closed position, cover 66 isolates connector block 12, terminals 22, 24, and electrical connections within terminal box 28 from the environment. In the open position, cover 66 provides access to the various components and electrical connections housed within terminal box 28.

Referring still to FIGS. 1-3, connector block 12 is adapted to be disposed on and to attach to terminals 22, 24 and thereby be secured to the exterior of shell 14. Connector block 12 connects three leads or wires 70 of the external power source to the current conducting pins 42 and 52 of terminals 22 and 24 in parallel. When secured, connector block 12 engages external surfaces 72 and 74 of terminals 22 and 24, respectively, and receives portions of coupling straps 26 and current conducting pins 42 and 52 of terminals 22 and 24, respectively. Wires 70 are attached to connector block 12 via respective threaded fasteners 76. In various aspects, threaded fasteners 76 are made from a conductive material, such as zinc coated steel or brass.

With additional reference to FIGS. 4-10, an exemplary implementation of connector block 12 is shown in detail and will now be described. For reference, an x-axis, a y-axis, and a z-axis are shown in each of FIGS. 2-10. The x-axis, y-axis, and z-axis extend in what will generally be referred to as a longitudinal direction, a transverse direction, and a lateral direction, respectively, with respect to connector block 12. With initial reference particularly to FIGS. 2-4, connector block 12 includes a nonconductive body 100, and a plurality of conductive connectors or bridging straps 102. Generally, the number of bridging straps 102 will be equal to the number of pairs of current conducting pins 42 and 52 to be connected in parallel. In the present example, three bridging straps 102 and six coupling straps 26 are illustrated.

Nonconductive body 100 can be molded from a suitable nonconductive material which also preferably resists absorbing moisture (e.g., hydrophobic). For example, nonconductive body 100 can be made from a polymeric material. Nonconductive body 100 includes a support 110, bosses 112, 114, a boundary wall 116, and two partition walls 118. In various aspects, support 110, bosses 112, 114, boundary wall 116, and partition walls 118 can be formed integral to each other as a single piece part. For example, support 110, bosses 112, 114, boundary wall 116, and partition walls 118 can be molded together. In a preferred example, connector block 12 is molded from a phenolic material as a single piece part.

Figure 5:
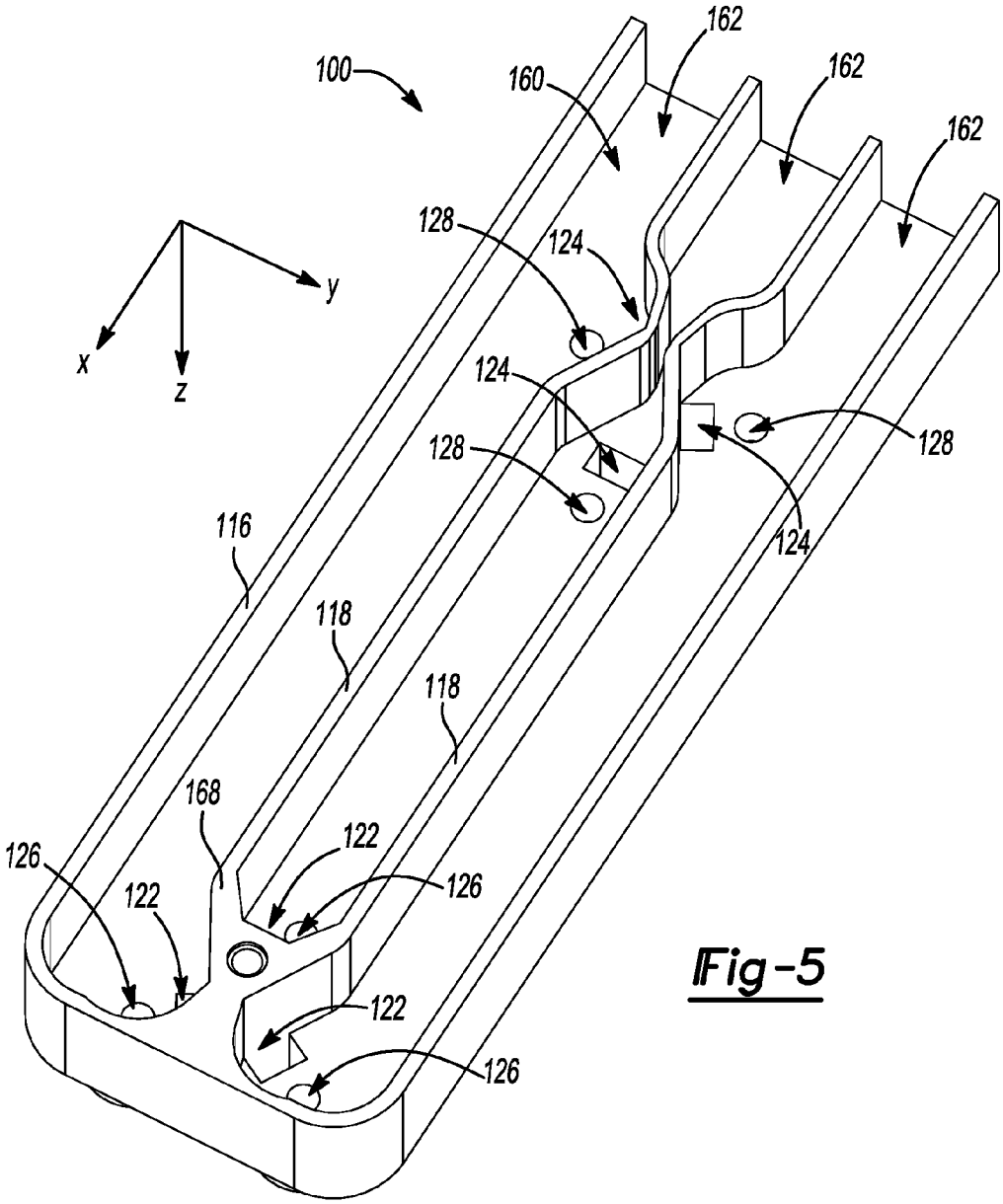
FIG. 5 is a perspective view of a body of the connector block of FIG. 1.
Figure 6:
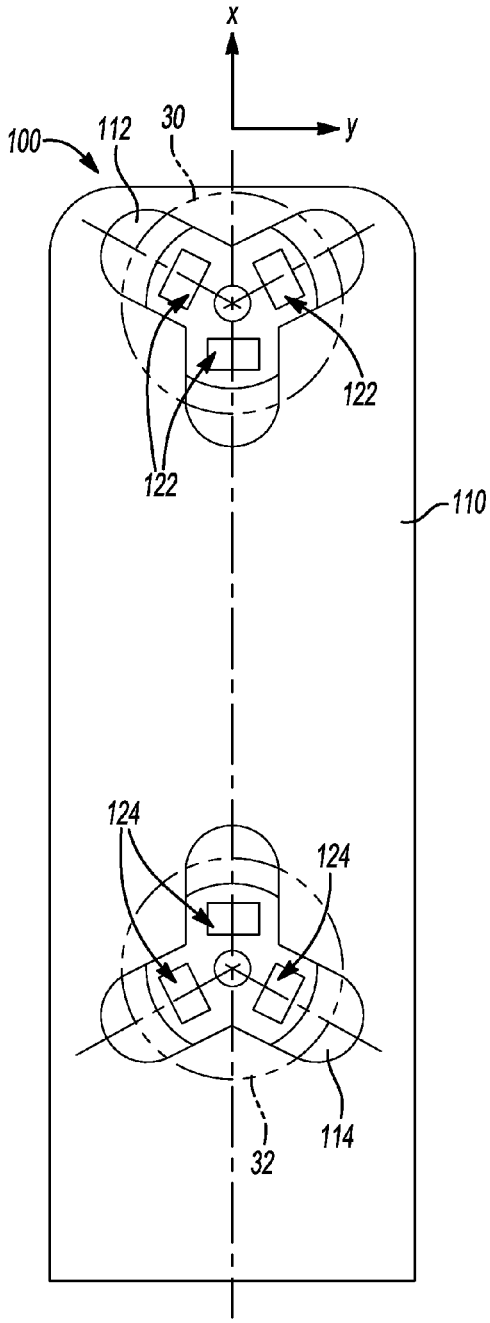
FIG. 6 is a bottom view illustrating the connector block of FIG. 1.
Figure 7:
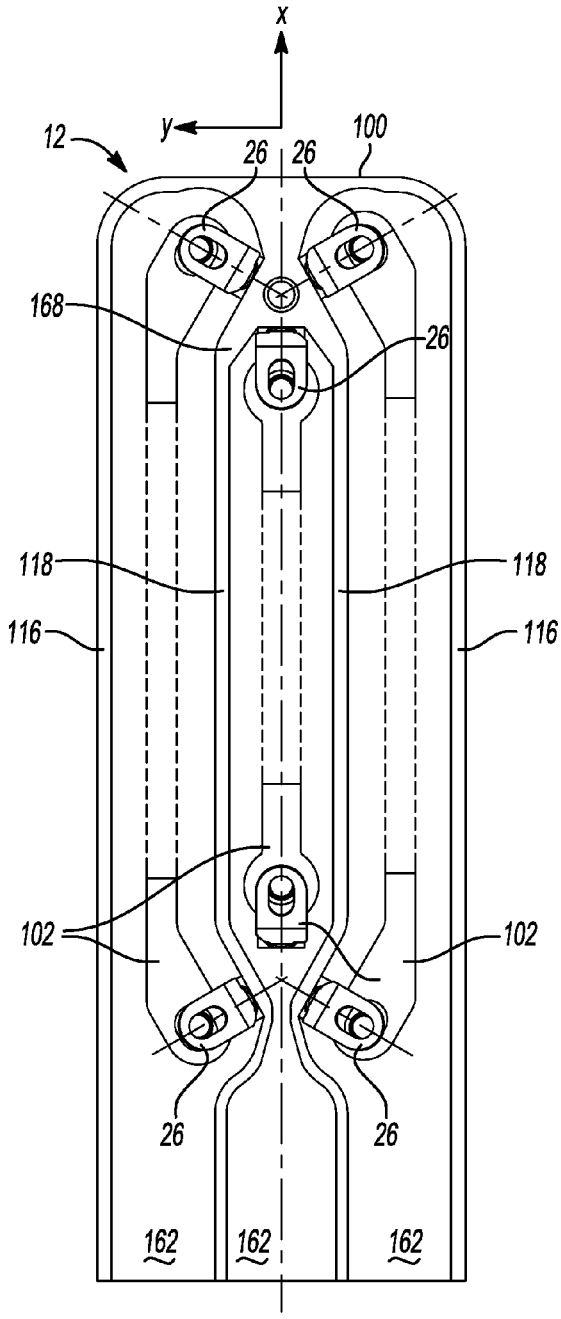
FIG. 7 is a top view illustrating the connector block of FIG. 1.
Figure 8:
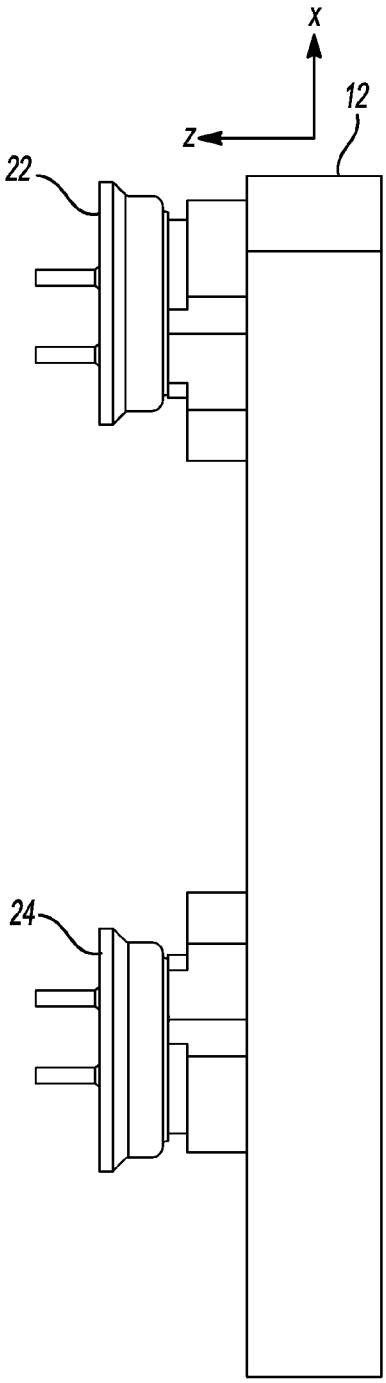
FIG. 8 is a side view illustrating the connector block of FIG. 1.
Figure 9:
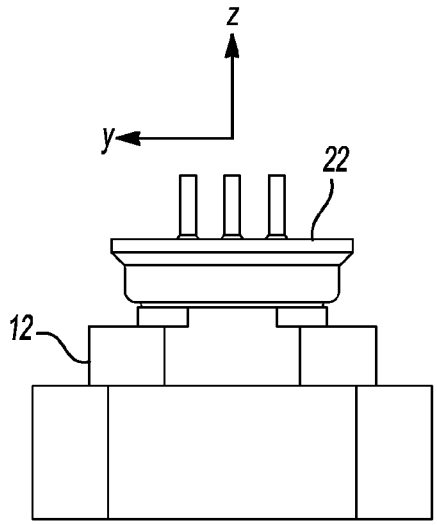
FIG. 9 is a front view illustrating the connector block of FIG. 1.
Figure 10:
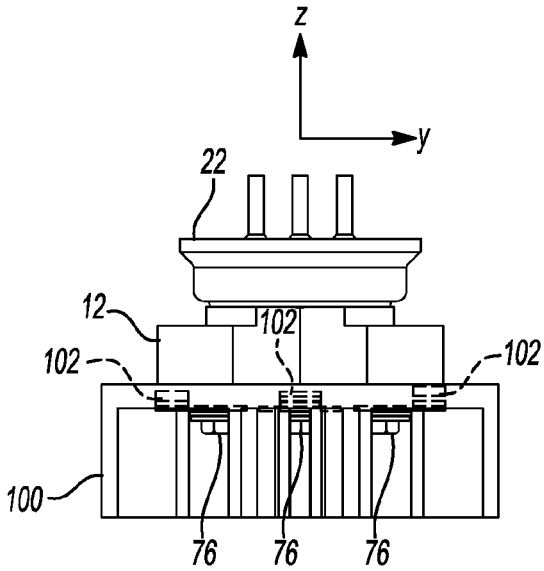
FIG. 10 is a back view illustrating the connector block of FIG. 1.

Nonconductive body 100 further includes a plurality of rectangular-shaped through holes 122 and 124, and a plurality of blind holes 126 and 128 (FIG. 5). Through holes 122 and 124 extend through bosses 112 and 114, respectively, and support 110. Through holes 122 and 124 are each sized to receive coupling straps 26, current conducting pins 42 and 52, respectively, and portions of elastomeric gaskets 46 and 56 that circumscribe current conducting pins 42 and 52.

Blind holes 126 and 128 extend through support 110 and partially through bosses 112 and 114, respectively. Blind holes 126 and 128 are located adjacent through holes 122 and 124, respectively, and are adapted to receive conductive threaded inserts 130 used to secure an electrical connection between wires 70, bridging straps 102, and coupling straps 26 as discussed in further detail below. Threaded inserts 130 are generally cylindrical in shape and include internal threads. Threaded inserts 130 are manufactured from a metal, which preferably is zinc coated steel. Threaded inserts 130 can be secured within blind holes 126 and 128 according to various methods. For example, threaded inserts 130 can be molded in when forming nonconductive body 100 using a suitable insert molding process, or can be pressed into blind holes 126 and 128 after forming nonconductive body 100.

Support 110 is a generally flat structure that supports bosses 112, 114 on a first side 132, and boundary wall 116, partition walls 118 and bridging straps 102 on a second side 134 opposite first side 132. Support 110 has a generally rectangular shape when viewed in the lateral direction. Support 110 electrically insulates bridging straps 102 from components located on the first side 132.

Bosses 112 and 114 protrude from the first side 132 of support 110 and are adapted to engage external surfaces 72 and 74 of terminals 22 and 24, respectively, and, more particularly, elastomeric gaskets 46 and 56. Bosses 112, 114 provide a desired lateral spacing between support 110 and shell 14. Bosses 112 and 114 define portions of the through holes 122 and 124 extending through nonconductive body 100, respectively. Boss 112 includes a base section 140 and an engagement section 142. Base section 140 extends from support 110 and engagement section 142 extends from base section 140. Base section 140 defines portions of blind holes 126. Boss 114 includes a base section 150 and an engagement section 152. Base section 150 extends from support 110 and engagement section 152 extends from base section 150. Base section 150 defines portions of blind holes 128.

Boundary wall 116 extends from support 110 in the lateral direction and along three peripheral sides of support 110. Together, boundary wall 116 and support 110 define an interior space 160 adjacent to the second side 134 of support 110. Partition walls 118 extend from support 110 in the lateral direction within the interior space 160 and generally along a length of support 110 in the longitudinal direction. Partition walls 118 partition interior space 160, and together with boundary wall 116 define a plurality of isolated channels 162. Channels 162 have a width in the transverse direction that provides a creepage distance or spacing sufficient to isolate bridging straps 102 from each other. For purposes of the present example, a spacing of at least around 12.7 millimeters (mm) can provide suitable isolation.

Channels 162 are open at one end and closed at an opposite end, the end pointed to by x-axis. Each of the channels 162 extends between and intersects with a respective pair of the through holes 122 and 124, thereby providing communication between the first and second sides 132 and 134. Each of the channels 162 further intersects with a respective pair of blind holes 126 and 128. Partition walls 118 and 120 join together and join to a transverse section of boundary wall 116 extending along the closed end to create a wall section 168 (FIG. 5) that closes channels 162. In various aspects, a height and/or a width of partition walls 118 can be the same and can be the same as a height and/or a width of boundary wall 116.

Together, bridging straps 102 and coupling straps 26 are adapted to electrically connect wires 70 to respective pairs of current conducting pins 42 and 52 and thereby connect terminals 22 and 24 in parallel. Bridging straps 102 can be manufactured from a suitable metal material. Bridging straps 102 are generally flat and elongate parts manufactured from a sheet metal material, which preferably is copper or a copper alloy such as brass, or an aluminum material. Each of the bridging straps 102 is adapted to extend between a respective pair of blind holes 126 and 128. Bridging straps 102 are disposed on the second side 134 within respective channels 162 and electrically isolated from each other by nonconductive body 100.

Each of the bridging straps 102 includes a laterally offset middle section 170 and end sections 172 and 174 extending from opposite ends of the middle section 170 that define eyelets 176 and 178, respectively. As best seen in FIGS. 2-3, middle sections 170 are embedded within nonconductive body 100 and, more particularly, within support 110, thereby coupling bridging straps 102 to nonconductive body 100. In various aspects, middle sections 170 are embedded to a depth D1 sufficient to isolate the middle sections 170 from the first side 132 and a depth D2 sufficient to isolate the middle sections 170 from the second side 134. For purposes of the present example, depths D1, D2 of at least around 0.7 mm can provide suitable isolation. Depth D2 can be greater than D1 as illustrated. Bridging straps 102 can be embedded when forming nonconductive body 100 using a suitable insert molding process.

Eyelets 176 and 178 are disposed over and generally in co-axial alignment with the respective blind holes 126 and 128. When bent to secure connector block 12 to compressor assembly 10 an eyelet of the strap engaging section 62 of each coupling strap 26 is generally co-axial with the respective eyelet 176 or 178 and blind hole 126 or 128. Each coupling strap 26 is secured to nonconductive body 100 by a fastener that passes through a respective eyelet of the strap engaging section 62, eyelet 176 or 178, and threads into a respective threaded insert 130. Fasteners 186 secure coupling straps 26 located at terminal 22. Fasteners 76 secure coupling straps 26 located at terminal 24 and wires 70. When secured, electrical connections between terminals 22, 24 and bridging straps 102 are created. In various aspects, fasteners 186 are made from a conductive material, and can be identical to fasteners 76.

Referring again to FIGS. 1-3, methods of assembling connector block 12 to compressor assembly 10 and wires 70 of the external power source to connector block 12 will be described in further detail. A method of assembling connector block 12 includes positioning connector block 12 over terminals 22 and 24 and respective coupling straps 26 as illustrated in FIG. 2. In particular, connector block 12 is positioned so that each of the current conducting pins 42 and 52 and respective coupling straps 26 are disposed within the respective through holes 122 and 124 and connector block 12 engages or abuts external surfaces 72 and 74 of terminals 22 and 24.

After positioning connector block 12, coupling straps 26 are bent towards their respective bridging straps 102 into an L-shape so that strap engaging sections 62 of coupling straps 26 are positioned over and abut end sections 172 and 174 of bridging straps 102. Thus positioned, coupling straps 26 can retain connector block 12 in a manner sufficient to enable compressor assembly 10 to be shipped to an end user or customer for final assembly of connector block 12, which can include assembly of wires 70. Next, connector block 12 is connected to terminals 22 and 24 using fasteners 76 and 186. To connect connector block 12 to terminal 22, fasteners 186 are passed through the eyelets of the coupling straps 26 associated with terminal 22 and eyelets 176 of bridging straps 102 and threaded into the respective threaded inserts 130. Fasteners 186 are torqued to compress coupling straps 26 and bridging straps 102 together to create the electrical connections between terminal 22 and connector block 12. According to various methods, fasteners 186 can be secured prior to connecting connector block 12 to terminal 24 and/or wires 70 to connector block 12. In this way, fasteners 186 can be used to further secure connector block 12 to compressor assembly 10 for shipping to a customer.

To connect connector block 12 to terminal 24, wires 70 are assembled to connector block 12 by passing wires 70 through respective channels 162 at the open end of connector block 12. Wires 70 are each then connected to terminal 24 by passing threaded fasteners 76 through respective eyelets of wire 70, eyelets of coupling straps 26 associated with terminal 24, and eyelets 178 of bridging strap 102 in that order. Then, threaded fasteners 76 are thread into the respective threaded insert 130 and torqued until bridging strap 102 and coupling straps 26 are compressed together to create the electrical connections. Once secured, fasteners 76 and 186 can fixedly, yet releaseably secure connector block 12 to compressor assembly 10.

Figure 11:
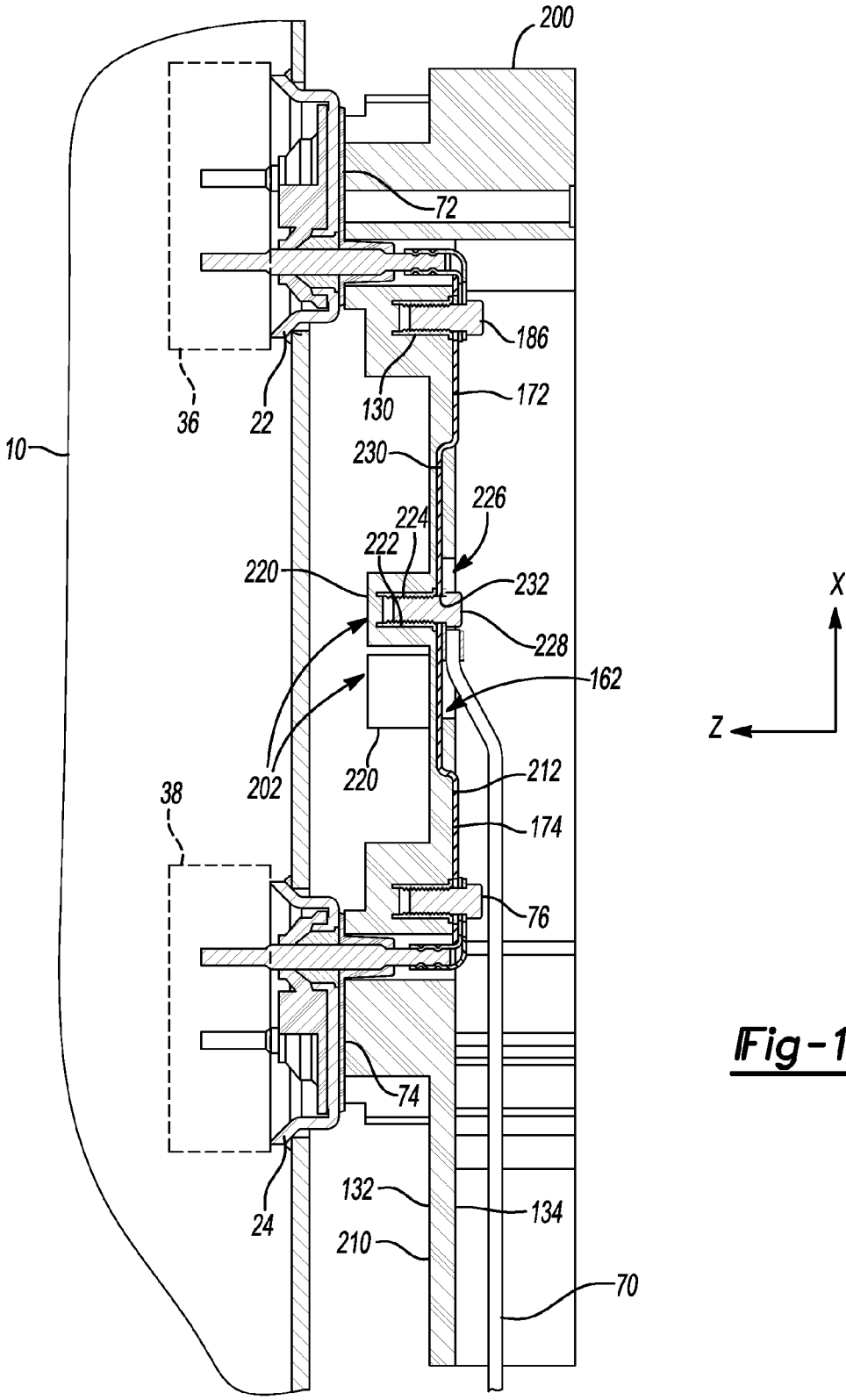
FIG. 11 is a partial cross-sectional view illustrating another exemplary connector block for the refrigeration compressor of FIG. 1.

With particular reference to FIG. 11, a partial cross-sectional view illustrates another exemplary connector block 200 for use with compressor assembly 10. The cross-sectional view of FIG. 11 illustrates a view of connector block 200 corresponding to that of connector block 12 shown in FIG. 2. Connector block 200 is substantially similar to connector block 12, except that connector block 200 includes features for creating separate connections 202 for connecting one or more wires 70 of an external power source (not shown) to connector block 200. Accordingly, it should be understood that the above description of connector block 12 applies equally to connector block 200, except as noted below or otherwise evident from the context.

According to the present example, connector block 200 includes three separate connections 202 for connecting wires 70 of the external power source to connector block 200. Connector block 200 includes a nonconductive body 210 and conductive connectors or bridging straps 212. Nonconductive body 210 is substantially similar to nonconductive body 100, except that nonconductive body 210 includes an additional boss 220, blind hole 222, threaded insert 224, and slotted recess 226 associated with each connection 202. Bosses 220 protrude from the same first side 132 (see FIG. 2) as bosses 112, 114 and are each adapted to support a respective threaded insert 224 within blind hole 222 in a manner substantially similar to that which bosses 112, 114 support threaded inserts 130.

Threaded inserts 224 are substantially similar to threaded inserts 130 and are each adapted to receive a fastener 228 used to secure the respective connection 202. Slotted recesses 226 are disposed over respective inserts 224 and extend through the second side 134, exposing respective portions of bridging straps 212 where wires 70 are attached to make the respective connections 202. In various aspects, slotted recesses 226 have a size and shape adapted to receive and retain the eyelets of wires 70 in a desired orientation with respect to connector block 200. For example, slotted recesses 226 can have a size and shape which is generally complementary to that of the ends or eyelets of wires 70.

Bridging straps 212 are substantially similar to bridging straps 102, except that each includes a middle section 230 defining a through hole 232. Middle sections 230 can be embedded to a desired depth similar to middle sections 170 of connector block 12. Through holes 232 are disposed within slotted recesses 226 over respective inserts 224. Through holes 232 are generally coaxially aligned with inserts 224 to allow fasteners 228 to pass through.

With continued reference to FIG. 11, exemplary methods of assembling connector block 200 and wires 70 to compressor assembly 10 will be described in further detail. A method of assembling connector block 200 and wires 70 generally includes positioning connector block 200 relative to terminals 22 and 24, connecting connector block 200 to terminals 22 and 24, and connecting wires 70 to connector block 200 to form connections 202. Connector block 200 can be positioned relative to terminals 22 and 24 by positioning connector block 200 over terminals 22 and 24 and coupling straps 26 to abut externals surfaces 72 and 74 of terminals 22 and 24. Initially, connector block 200 can be positioned relative to terminals 22 and 24 in the same manner as connector block 12 as shown in FIG. 2. After positioning connector block 200, connector block 200 can be loosely secured to terminals 22 and 24 by bending coupling straps 26 towards respective bridging straps 212 into an L-shape so that strap engaging sections 62 of coupling straps 26 are positioned over and abut end sections 172 and 174 of bridging straps 212. Thus positioned, coupling straps 26 can retain connector block 200 in a manner sufficient to enable compressor assembly 10 to be shipped to a customer for final assembly of connector block 12, which can include connecting wires 70 of the external power source to connector block 200.

Next, connector block 200 can be connected to terminals 22 and 24 using fasteners 76 and 186. Fasteners 186 can be passed through the eyelets of the coupling straps 26 associated with terminal 22 and the eyelets 176 of bridging straps 212 and threaded into threaded inserts 130. Fasteners 186 can be tightened to compress coupling straps 26 and bridging straps 212 together to create electrical connections between terminal 22 and connector block 200. Fasteners 76 can be passed through the eyelets of the coupling straps 26 associated with terminal 24 and eyelets 178 of bridging straps 212 and threaded into threaded inserts 130. Fasteners 76 can be tightened to compress coupling straps 26 and bridging straps 212 together to create electrical connections between terminal 24 and connector block 200. Once tightened, fasteners 76 and 186 can fixedly, yet releaseably, secure connector block 200 to compressor assembly 10.

Wires 70 can be connected to connector block 200 by passing the wires 70 through respective channels 162 and securing connections 202. Connections 202 can be secured by passing fasteners 228 through eyelets of the associated wires 70, through holes 232 of the bridging straps 212 and threading fasteners 228 into threaded inserts 224. Fasteners 228 can be tightened to compress the eyelets of wires 70 and respective middle sections 230 of bridging straps 212 together to create connections 202.

Advantages of connector block 200 include an advantage that connector block 200 can be removed from compressor assembly 10 without disconnecting wires 70 of the external power source, for example, during servicing of compressor assembly 10. Connector block 200 can be removed by unthreading fasteners 76, 186 and straightening coupling straps 26. An additional advantage is connector block 200 can be positively secured to both terminals 22 and 24 of compressor assembly 10 via fasteners 76 and 186 without the need to secure wires 70. In this way, connector block 200 can be positively secured and shipped with compressor assembly 10 to a customer, who can subsequently connect wires 70.

While external connector blocks 12 and 200 of present disclosure has been described with reference to compressor assembly 10, it will be appreciated that external connector blocks 12 and 200 can be used in other applications using electrically-powered machines. It will be further appreciated that external connector blocks 12 and 200 can be scaled up to provide parallel electrical connections between three or more terminals similar to the connections provided for terminals 22, 24.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An external connector block for connecting a first terminal and a second terminal of an electric machine to an external power source, comprising:

a nonconductive body having a longitudinal axis, the nonconductive body including:

a support having a first side and a second side, a first boss disposed on the first side of the support and adapted to engage the first terminal, the first boss and the support defining a first set of N holes extending through the first boss and the support to the second side and adapted to receive a first set of N current conducting pins of the first terminal, N being an integer greater than two, a second boss disposed on the first side of the support and adapted to engage the second terminal, the second boss longitudinally spaced apart from the first boss, the second boss and the support defining a second set of N holes extending through the second boss and the support to the second side and adapted to receive a second set of N current conducting pins of the second terminal, and walls extending from the second side and defining N longitudinally extending channels separated from each other by the walls; and N conductive connectors coupled to the second side of the nonconductive body, each extending longitudinally within a respective one of the channels and adapted to connect a first pin of the first set of current conducting pins to a respective second pin of the second set of current conducting pins via a first hole of the first set of holes and a second hole of the second set of holes;

wherein one of the first boss and the second boss is adapted to couple to a fastener located on the second side used to secure the connector block to one of the first terminal and the second terminal; and wherein at least one of the conductive connectors is made from a metal member.

2. The connector block of claim 1, wherein at least one of the conductive connectors is at least partially embedded in the nonconductive body, thereby coupling the at least one conductive connector to the nonconductive body.

3. The connector block of claim 1, wherein the conductive connectors are adapted to connect to leads of the external power source at locations separate from the locations where the conductive connectors connect to the first set of current conducting pins and the second set of current conducting pins.

4. The connector block of claim 1, wherein the nonconductive body is made from a polymeric material.

5. The connector block of claim 1, further comprising:

a threaded insert for receiving a fastener used to connect one of the N conductive connectors to one of the first pin and the second pin, wherein the threaded insert is coupled to the second side and extends at least partially through one of the first boss and the second boss, and wherein the threaded insert overlaps the one conductive connector.

6. An apparatus, comprising:

an electric machine disposed within a housing;

a first terminal for supplying power to the electric machine, the first terminal extending through the housing and having a first set of N current conducting pins, N being an integer greater than two;

a second terminal for supplying power to the electric machine, the second terminal extending through the housing and having a second set of N current conducting pins; and a connector block for electrically connecting leads of an external power source to the first terminal and the second terminal on an exterior of the housing, the connector block including:

a nonconductive body having a first set of N holes extending through the nonconductive body to a second side and receiving the first set of current conducting pins, and a second set of N holes extending through the nonconductive body to the second side and receiving the second set of current conducting pins; and N conductive connectors, each having portions positioned on the second side and extending within a respective one of the channels and connecting a first pin of the first set of current conducting pins to a respective second pin of the second set of current conducting pins via a first hole of the first set of holes and a second hole of the second set of holes;

2N conductive coupling members, each disposed within one of the first set of holes and the second set of holes and overlapping one of the conductive connectors on the second side; and wherein the conductive connectors are made from a metal member.

7. The apparatus of claim 6, each conductive coupling member connected on a first end with one of the first set of current conducting pins and the second set of current conducting pins and on an opposite second end to a respective one of the conductive connectors.

8. The apparatus of claim 7, further comprising 2N threaded inserts for receiving a fastener used to connect the conductive coupling members to the conductive connectors, each of the threaded inserts coupled to the second side and extending at least partially through the nonconductive body in a lateral direction, each of the threaded inserts overlapping a respective one of the conductive connectors.

9. The apparatus of claim 7, wherein the conductive coupling members are resistance welded to the current conducting pins.

10. The apparatus of claim 6, wherein the conductive connectors are at least partially embedded in the nonconductive body, thereby coupling the conductive connectors to the nonconductive body.

11. The apparatus of claim 6, wherein the conductive connectors are adapted to connect to leads of the external power source at locations separate from the locations where the conductive connectors connect to the first set of current conducting pins and the second set of current conducting pins.

12. The apparatus of claim 6, wherein the nonconductive body is made from a polymeric material.

13. The apparatus of claim 6, wherein the electric machine is a refrigeration compressor.

14. The apparatus of claim 6, wherein the nonconductive body further comprises a plurality of walls extending from the second side, the walls defining N longitudinally extending channels separated from each other by the walls; and wherein each conductive connector extends along a respective one of the channels.

* * * * *